US010359182B2

(12) United States Patent
Sonneman

(10) Patent No.: US 10,359,182 B2
(45) Date of Patent: Jul. 23, 2019

(54) RING POWER BAR HANGER FOR MODULAR LIGHTING FIXTURE

(71) Applicant: Contemporary Visions, LLC, Larchmont, NY (US)

(72) Inventor: Robert A. Sonneman, Mamaroneck, NY (US)

(73) Assignee: Contemporary Visions, LLC, Larchmont, NY (US)

( * ) Notice: Subject to any disclaimer, the term of this patent is extended or adjusted under 35 U.S.C. 154(b) by 0 days.

(21) Appl. No.: 15/446,302

(22) Filed: Mar. 1, 2017

(65) Prior Publication Data

US 2018/0128466 A1 May 10, 2018

Related U.S. Application Data

(63) Continuation-in-part of application No. 29/587,711, filed on Dec. 15, 2016, now Pat. No. Des. 801,576.

(60) Provisional application No. 62/419,505, filed on Nov. 9, 2016.

(51) Int. Cl.

| | |
|---|---|
| ***F21S 8/06*** | (2006.01) |
| ***F21V 21/35*** | (2006.01) |
| ***F21V 23/02*** | (2006.01) |
| ***F21V 23/06*** | (2006.01) |
| ***F21V 21/008*** | (2006.01) |

(Continued)

(52) U.S. Cl.

CPC ..... *F21V 21/35* (2013.01); *F21S 2/005* (2013.01); *F21S 8/063* (2013.01); *F21V 21/008* (2013.01); *F21V 21/104* (2013.01); *F21V 23/02* (2013.01); *F21V 23/06* (2013.01); *H01R 25/14* (2013.01); *F21S 8/066* (2013.01); *F21Y 2115/10* (2016.08)

(58) Field of Classification Search

CPC .... F21S 8/02; F21S 6/003; F21S 10/00; F21S 8/063; F21S 8/066; F21S 8/038; F21Y 2103/003; F21V 21/04; F21V 21/35; F21V 21/008; F21V 21/104; E04B 9/006; F21F 21/005

USPC ..... 362/147, 148, 150, 249.1

See application file for complete search history.

(56) References Cited

U.S. PATENT DOCUMENTS

| | | | |
|---|---|---|---|
| 2,292,395 | A | 8/1942 | O'Brien |
| D217,785 | S | 6/1970 | Wolff |

(Continued)

FOREIGN PATENT DOCUMENTS

| | | | |
|---|---|---|---|
| CN | 200 986 123 | Y | 12/2007 |
| CN | 205261379 | U | 5/2016 |

(Continued)

OTHER PUBLICATIONS

USPTO, Non-Final Office Action dated Jan. 13, 2017 issued in corresponding U.S. Appl. No. 15/251,369.

(Continued)

*Primary Examiner* — William N Harris

(74) *Attorney, Agent, or Firm* — Gottlieb, Rackman & Reisman, P.C.

(57) ABSTRACT

A modular lighting system that includes power bars that can transfer power and hangers that support that support the power bars which can be vertically offset from each other. A hanger can have two cylindrical members that each engage one of the power bars, and rods can extend between the cylindrical members to provide both mechanical support and electrical connection between the power bars.

10 Claims, 17 Drawing Sheets

(51) Int. Cl.

| | |
|---|---|
| ***H01R 25/14*** | (2006.01) |
| ***F21Y 115/10*** | (2016.01) |
| ***F21V 21/104*** | (2006.01) |
| ***F21S 2/00*** | (2016.01) |

(56) References Cited

U.S. PATENT DOCUMENTS

| | | | | |
|---|---|---|---|---|
| D222,748 | S | 12/1971 | Strianese | |
| 3,716,031 | A | 2/1973 | Rowbury | |
| 3,748,463 | A | 7/1973 | Trassinelli | |
| 4,723,747 | A | 2/1988 | Karp | |
| 4,758,935 | A | 7/1988 | Frassati et al. | |
| 4,763,870 | A | 8/1988 | Wodlinger | |
| D301,304 | S | 5/1989 | Will | |
| D317,058 | S | 5/1991 | Sonneman | |
| 5,025,355 | A | 6/1991 | Harwood | |
| D320,465 | S | 10/1991 | Sonneman | |
| 5,065,295 | A | 11/1991 | De La Haye et al. | |
| 5,105,349 | A | 4/1992 | Falls | |
| D360,046 | S | 7/1995 | Sugiura | |
| 5,440,469 | A | 8/1995 | Gomes | |
| 5,455,754 | A | 10/1995 | Hoffner | |
| 5,584,576 | A | 12/1996 | Wei Hong | |
| D392,407 | S | 3/1998 | Johnson et al. | |
| 5,833,358 | A | 11/1998 | Patik | |
| 6,135,615 | A | 10/2000 | Lee | |
| 6,179,442 | B1 | 1/2001 | Schurle | |
| 6,241,369 | B1 | 6/2001 | Mackiewicz | |
| 6,244,733 | B1 | 6/2001 | Fong et al. | |
| 6,341,979 | B1 | 1/2002 | Yamamoto | |
| 6,409,524 | B1 | 6/2002 | Miller et al. | |
| 6,489,748 | B1 | 12/2002 | Okamura | |
| 6,659,623 | B2 | 12/2003 | Friend | |
| 6,769,790 | B2 | 8/2004 | Hermann | |
| D507,374 | S | 7/2005 | Chen | |
| 7,172,332 | B2 * | 2/2007 | Mobarak | F21V 21/35 362/147 |
| 7,246,935 | B2 | 7/2007 | Benghozi et al. | |
| 7,397,384 | B1 | 7/2008 | MacKenzie, IV | |
| 7,503,778 | B2 | 3/2009 | Lehman et al. | |
| 7,507,005 | B1 | 3/2009 | Mier-Langner | |
| 7,520,762 | B2 * | 4/2009 | Lehman | F21V 21/35 439/115 |
| 7,520,763 | B1 | 4/2009 | Buse | |
| 7,527,406 | B2 | 5/2009 | Kwon | |
| D595,884 | S | 7/2009 | Liao | |
| 7,563,000 | B2 | 7/2009 | Gierveld | |
| 7,571,736 | B1 | 8/2009 | Chu | |
| 7,654,834 | B1 | 2/2010 | Imier-Langner et al. | |
| D611,169 | S | 3/2010 | Harder | |
| D620,168 | S | 7/2010 | Sabernig | |
| 7,794,132 | B2 | 9/2010 | Cunius | |
| 7,798,824 | B2 * | 9/2010 | Fong | H01R 33/22 362/147 |
| 7,806,913 | B2 | 10/2010 | Fanger | |
| D629,954 | S | 12/2010 | Compton | |
| D632,423 | S | 2/2011 | Canfield | |
| 7,955,125 | B1 | 6/2011 | Petrillo | |
| D648,470 | S | 11/2011 | Rains | |
| D649,692 | S | 11/2011 | Trzesniowski | |
| 8,061,865 | B2 | 11/2011 | Piepgras et al. | |
| D671,670 | S | 11/2012 | Sonneman | |
| 8,398,276 | B2 | 3/2013 | Pearson et al. | |
| D680,673 | S | 4/2013 | Levine | |
| D689,221 | S | 9/2013 | Isaac | |
| 8,523,378 | B2 * | 9/2013 | Schulzman | F04D 25/088 362/147 |
| 8,584,412 | B2 | 11/2013 | Frecska et al. | |
| 8,616,871 | B2 | 12/2013 | Galomb | |
| 8,733,710 | B1 | 5/2014 | Suazo | |
| 8,794,804 | B2 | 8/2014 | Verfuerth | |
| 8,814,383 | B2 | 8/2014 | Bizzotto et al. | |
| 8,840,319 | B2 | 9/2014 | Hogue | |
| 8,967,573 | B2 | 3/2015 | Hemmer | |
| D739,070 | S | 9/2015 | Wilson | |
| 9,136,659 | B2 | 9/2015 | Fishman et al. | |
| D747,636 | S | 1/2016 | Maher | |
| 9,387,268 | B2 | 7/2016 | Farren | |
| D765,296 | S | 8/2016 | Wei | |
| 9,464,772 | B2 * | 10/2016 | O'Brien | F21S 8/066 |
| 9,472,912 | B2 | 10/2016 | Schirmeier | |
| D772,467 | S | 11/2016 | Sonneman | |
| D772,475 | S | 11/2016 | Sonneman | |
| D773,099 | S | 11/2016 | Sonneman | |
| D773,101 | S | 11/2016 | Sonneman | |
| D773,715 | S | 12/2016 | Sonneman | |
| D773,719 | S | 12/2016 | Sonneman | |
| D773,725 | S | 12/2016 | Sonneman | |
| D775,397 | S | 12/2016 | Sonneman | |
| D779,113 | S | 2/2017 | Sonneman | |
| D779,437 | S | 2/2017 | Sonneman | |
| D779,712 | S | 2/2017 | Sonneman | |
| D779,713 | S | 2/2017 | Sonneman | |
| D779,714 | S | 2/2017 | Sonneman | |
| D779,715 | S | 2/2017 | Sonneman | |
| D782,990 | S | 4/2017 | Sonneman | |
| 9,618,172 | B1 * | 4/2017 | Means, III | F21S 8/066 |
| 9,739,460 | B2 | 8/2017 | Haubach | |
| 9,765,954 | B2 | 9/2017 | Zaderej et al. | |
| 2003/0031018 | A1 | 2/2003 | Bray et al. | |
| 2003/0103347 | A1 | 6/2003 | Friend | |
| 2004/0005798 | A1 | 1/2004 | Lin | |
| 2004/0160767 | A1 | 8/2004 | Mobarak et al. | |
| 2005/0207173 | A1 | 9/2005 | Benghozi | |
| 2007/0053209 | A1 | 3/2007 | Uhler et al. | |
| 2007/0115694 | A1 | 5/2007 | Mobarak et al. | |
| 2007/0247845 | A1 | 10/2007 | Udo | |
| 2008/0190043 | A1 * | 8/2008 | Beckmann | A47H 21/00 52/64 |
| 2009/0051292 | A1 | 2/2009 | Noh | |
| 2009/0123994 | A1 | 5/2009 | Lafaye et al. | |
| 2010/0271834 | A1 | 10/2010 | Muessli | |
| 2010/0271847 | A1 | 10/2010 | Mobarak et al. | |
| 2012/0257388 | A1 | 10/2012 | Bracher et al. | |
| 2013/0279180 | A1 * | 10/2013 | Pearson | F21V 21/008 362/371 |
| 2014/0226315 | A1 | 8/2014 | Nicieja et al. | |
| 2015/0198311 | A1 | 7/2015 | O'Brien et al. | |
| 2015/0316238 | A1 | 11/2015 | Guilmette | |
| 2015/0338037 | A1 | 11/2015 | Wang et al. | |
| 2016/0033098 | A1 | 2/2016 | Bergman et al. | |
| 2017/0184290 | A1 * | 6/2017 | Chiu | F21V 21/35 |
| 2017/0198892 | A1 | 7/2017 | Sonneman | |
| 2018/0160891 | A1 * | 6/2018 | Ahearn | F21S 8/06 |

FOREIGN PATENT DOCUMENTS

| | | | |
|---|---|---|---|
| DE | 8708815 | U1 | 11/1987 |
| DE | 4414046 | A1 | 10/1995 |
| DE | 29705852 | U1 | 5/1997 |
| DE | 19849101 | A1 | 4/1999 |
| DE | 202004001178 | U1 | 5/2004 |
| EP | 0320661 | A2 | 6/1989 |
| EP | 0379244 | A1 | 7/1990 |
| EP | 0734108 | A2 | 9/1996 |
| EP | 1757858 | A2 | 2/2007 |
| EP | 1847763 | A1 | 10/2007 |
| EP | 2821695 | A1 | 1/2015 |
| EP | 3196547 | A1 | 7/2017 |
| FR | 608 016 | A | 7/1926 |
| FR | 2588713 | A1 | 4/1987 |
| WO | 2016/132361 | A1 | 8/2016 |
| WO | 2016/150564 | A2 | 9/2016 |

OTHER PUBLICATIONS

USPTO, Non-Office Action dated Mar. 3, 2017 issued in corresponding U.S. Appl. No. 15/255,289.

USPTO, Non-Final Office Action dated Mar. 7, 2017 issued in corresponding U.S. Appl. No. 15/287,897.

USPTO, Non-Final Office Action dated Feb. 10, 2017 issued in corresponding U.S. Appl. No. 15/286,977.

(56) References Cited

OTHER PUBLICATIONS

USPTO, Non-Final Office Action dated Mar. 1, 2017 issued in corresponding U.S. Appl. No. 15/378,207.
USPTO, Non-Final Office Action dated Dec. 22, 2016 issued in corresponding U.S. Appl. No. 15/197,919.
USPTO, Final Office Action dated Apr. 5, 2017 issued in corresponding U.S. Appl. No. 15/197,919.
EPO, Extended European Search Report dated Jun. 26, 2017 issued in corresponding European Patent Application No. 171506868.8.
USPTO, Non-Final Office Action dated Aug. 18, 2017 issued in corresponding U.S. Appl. No. 15/584,171.
USPTO, Non-Final Office Action dated Sep. 27, 2017 issued in corresponding U.S. Appl. No. 15/407,085.
USPTO, Final Office Action dated Jun. 6, 2017 issued in corresponding U.S. Appl. No. 15/251,369.
USPTO, Non-Final Office Action dated Sep. 7, 2017 issued in corresponding U.S. Appl. No. 15/287,897.
Non-Final Office Action dated Jan. 17, 2018 issued in corresponding U.S. Appl. No. 15/427,217.
Non-Final Office Action dated Dec. 22, 2017 issued in corresponding U.S. Appl. No. 15/584,171.
Final Office Action dated Dec. 29, 2017 issued in corresponding U.S. Appl. No. 15/287,897.
Non-Final Office Action dated Jan. 12, 2018 issued in corresponding U.S. Appl. No. 15/801,855.
Non-Final Office Action dated Jan. 11, 2018 issued in corresponding U.S. Appl. No. 15/801,893.
Non-Final Office Action dated Jan. 11, 2018 issued in corresponding U.S. Appl. No. 15/808,109.
EPO, Extended European Search Report dated Jan. 3, 2018 issued in corresponding European Patent Application No. 17200563.9.
EPO, Extended European Search Report dated Jan. 5, 2018 issued in corresponding European Patent Application No. 17200550.6.
Extended European Search Report dated Mar. 27, 2018 issued in corresponding European Patent Application No. 17200553.0 filed Nov. 8, 2017.
Extended European Search Report dated Mar. 28, 2018 issued in corresponding European Patent Application No. 17200535.7 filed Nov. 8, 2017.
Extended European Search Report dated Mar. 28, 2018 issued in corresponding European Patent Application No. 17200541.5 filed Nov. 8, 2017.
Partial European Search Report dated Apr. 24, 2018 issued in corresponding European Patent Application No. 17200544.9 filed Nov. 8, 2017.
CIPO, First Office Action dated Sep. 25, 2018 issued in corresponding Canadian Patent Application No. 2,984,651 filed Nov. 2, 2017.
CIPO, First Office Action dated Sep. 25, 2018 issued in corresponding Canadian Patent Application No. 2,984,672 filed Nov. 2, 2017.
EPO, Extended European Search Report dated Aug. 7, 2018 issued in corresponding European Patent Application No. 17200544.9 filed Nov. 8, 2017.

* cited by examiner

RING POWER BAR HANGER FOR MODULAR LIGHTING FIXTURE

CROSS-REFERENCE TO RELATED APPLICATIONS

This application claims priority to U.S. Provisional Patent Application No. 62/419,505, filed Nov. 9, 2016, and is a continuation-in-part patent application of U.S. Design patent application No. 29/587,711, filed on Dec. 15, 2016, and issued as U.S. Design Pat. No. D801,576, which are hereby incorporated by reference in their entirety as part of the present disclosure.

FIELD OF THE INVENTION

This invention generally pertains to a modular lighting system and more specifically to a modular lighting system that includes power bars and connectors interconnecting two power bars in the modular lighting system, supporting the power bars and, optionally, can provide power to the power bars.

BACKGROUND OF THE INVENTION

Designing lighting for a space has always been a challenge because lighting equipment has to meet utilitarian, technical and aesthetic needs. Thus, any such endeavor is successful only if combining technical, architectural and artistic skills.

Several different types of ceiling lights are presently available, including surface mounted lights, recessed lights and hanging lights. The present invention pertains to hanging lights.

SUMMARY OF THE INVENTION

The present invention is directed to a modular lighting system that includes canopies that are connectable to a power source, a plurality of power bars, a plurality of hangers, including a first set of hangers supporting power bars from the canopy, a second set of hangers, and a plurality of pendants that are supported by the second set of hangers. The hangers and the power bars cooperate to provide electric power to the pendants from the canopy.

In an embodiment, one of the hangers can be configured to simultaneously hang and interconnect two power bars such that the power bars are oriented in line with each other. The hanger has a body with two cavities that are configured to receive respective ends of the power bars.

Each power bar can include two bar segments that face each other and are made of a non-conductive material. Conductive rails are provided on the inner surface of each bar segment. The hangers include a base configured to form an interference fit with the bar segments. In one embodiment, the hangers include two conductive parallel rods or cables that are in electrical contact with the rails through the respective bases.

These various elements are combined in many different ways resulting in a virtually infinite number of configurations. One configuration may include several bars disposed in a vertical plane. In another configuration, several bars can extend at different angles in one plane and are joined at a common point. Another configuration may include a combination of the two configurations previously described.

Another configuration may include several bars disposed at different heights or tiers with some bars perpendicular to other bars.

In an embodiment, clips are provided within the cavities of the bodies of the hangers that are configured to engage and form an interference fit with respective rails within the power bars. Optionally, the clips of one cavity are connected to clips of the other cavity by respective connecting elements within the body, thereby providing electrical connection between the power bars.

In one embodiment, a rod extends upward from an inner wall that separates the two cavities. The rod is electrically insulated from the clips.

In another embodiment, two rods extend upwardly from body and are electrically connected to the clips. The power can be provided either through one of the power bars to the hanger or from the two rods.

DETAILED DESCRIPTION OF EMBODIMENTS OF THE INVENTION

With reference now to the drawings, and in particular to FIGS. 1 through 6C, embodiments of modular lighting systems and elements thereof of the present invention will be described.

In general, each modular lighting system of the present disclosure includes one or more canopies, a plurality of hangers, a plurality of power bars and a plurality of pendants. The hangers can include (1) parallel hangers and/or (2) perpendicular hangers. Parallel hangers are used to support one power bar beneath another in parallel. Perpendicular hangers are used to support one power bar from another that extend perpendicular to each other. Hangers can support power bars from canopies, power bars from ceilings without a power connection and pendants. As will be described in detail below, each hanger must be able to interface with a power bar at at least one end. In addition, some systems may include connectors.

Unless otherwise noted, all of the hangers and all of the power bars described herein and illustrated in the figures include two interconnected elements.

Figure 1:
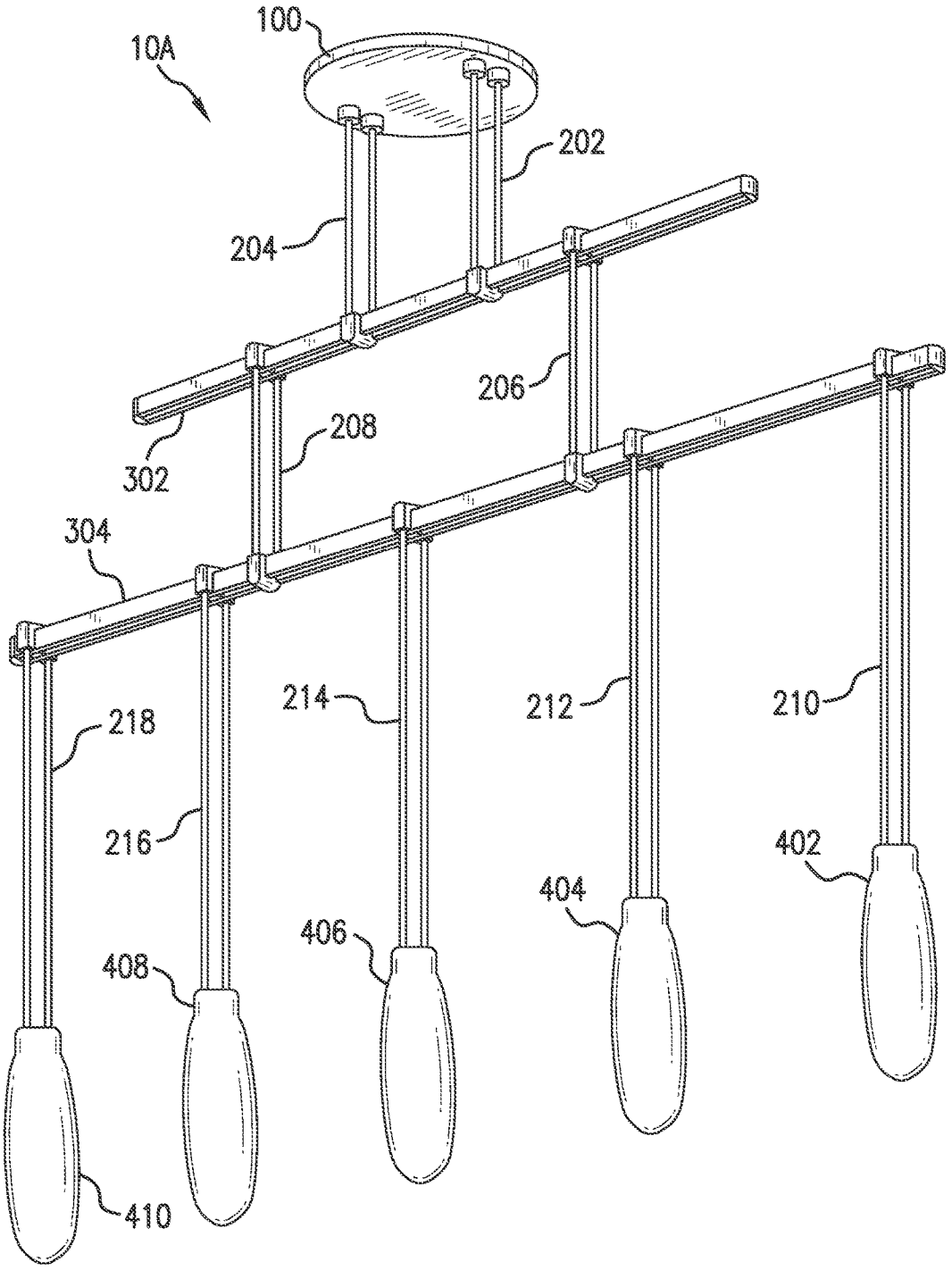
FIG. 1 is a perspective view of an embodiment of a modular lighting system.

FIG. 1 shows an embodiment of a modular lighting system 10A that includes a canopy 100 that supports the modular lighting system 10A from a ceiling or other similar architectural member in a conventional manner. In this case, the canopy 100 also provides power to the modular lighting system 10A. Other, more complicated lighting systems may have several canopies that support such systems and only some or only one canopy may provide power. Here, the canopy 100 includes a conventional power supply connected to standard AC lines that provide power to LED tubes in the pendants 402, 404, 406, 408, 410 as discussed below. The power supply is hidden.

Two power feed hangers 202, 204 extend downwardly from the canopy 100. In an embodiment, each hanger discussed hereinafter includes two solid bars or rods. In another embodiment, the power feed hangers 202, 204 are replaced by multi-strand twisted steel cables.

Pendant hangers 210, 212, 214, 216, 218 are used to support a plurality of pendants 402, 404, 406, 408, 410, respectively. The pendants 402, 404, 406, 408, 410 preferably include LED bulbs that run on 24 VAC.

Preferably, one of the power feed hangers 202, 204, which each include two hanger segments, is connected to a transformer disposed within the canopy 100. In an embodiment, power from the power feed hanger 202 flows through the first power bar 302, the hanger 206, the second power bar 304 and the hangers 210, 212, 214, 216, 218 to the pendants 402, 404, 406, 408, 410, respectively. The transformer steps down the line voltage from a standard power line to 24 VAC for the pendants 402, 404, 406, 408, 410. The other power feed hanger 204 may be electrically floating. Thus, in this embodiment, all of the power bars 302, 304 carry power. However, only some of the hangers carry power.

Figure 2:
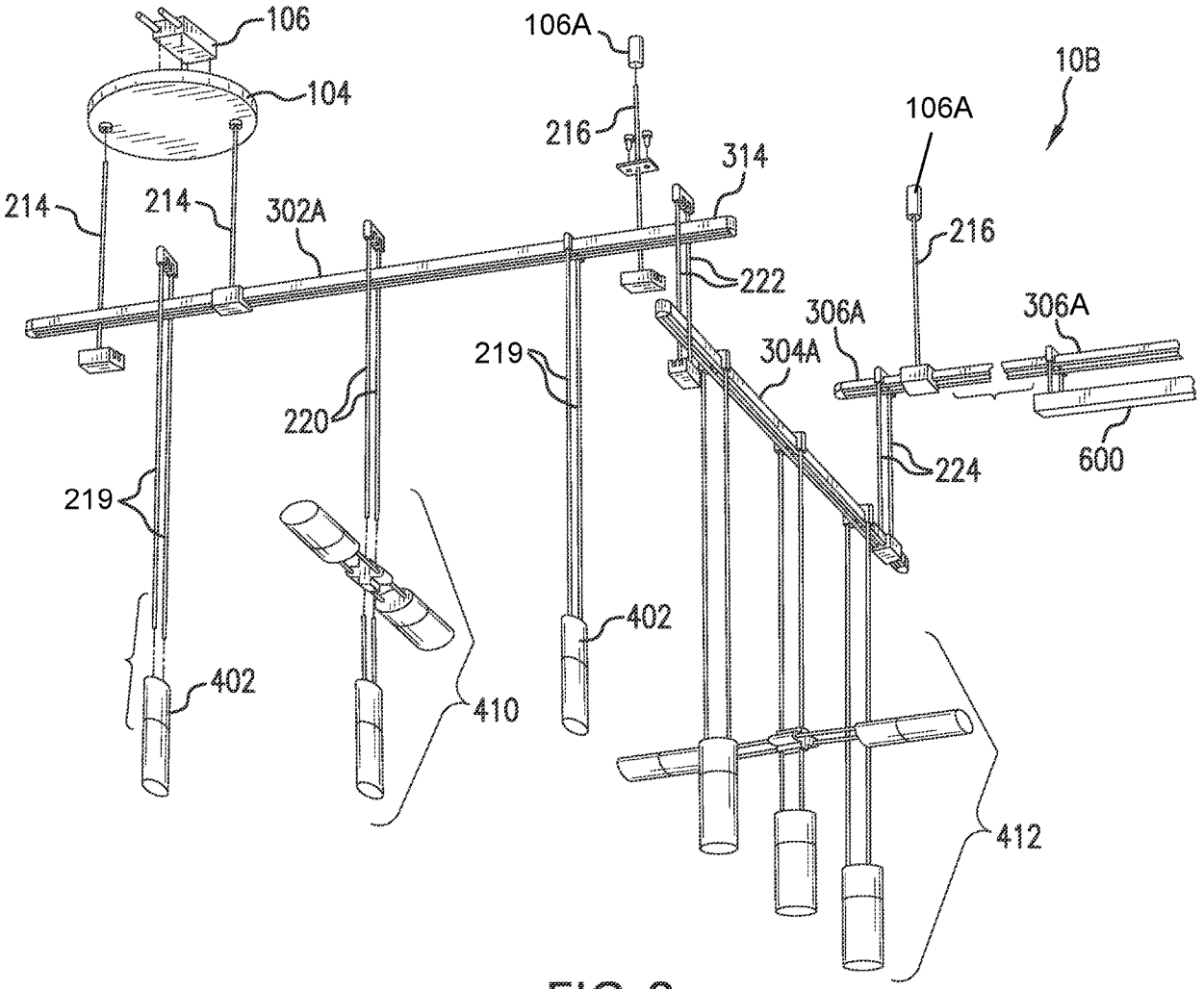
FIG. 2 is a perspective view of another embodiment of modular lighting system.

FIG. 2 illustrates an embodiment of another modular lighting system 10B. This modular lighting system 10B includes a canopy 104 with a transformer 106. Two hangers 214 extend from the canopy 104 and a first bar 302A is secured to the hangers 214. As opposed to the hangers 202, 204, 206, 208, 210, 212, 214, 216, 218 of the modular lighting system 10A of FIG. 1 that include two vertically extending elements, the hangers 214 in FIG. 2 have a single vertically extending element, such as a rod. Each of the hangers 214 provides power to one of the elements of the first power bar 302A. However, because the first power bar 302A is not centered below the canopy 104, but rather extends in one direction away from the canopy 104, another hanger 216, which may be referred to as a ceiling hanger, is used to support a distal end 314 of the first power bar 302. The top end of the ceiling hanger 216 is attached to a sleeve 106A that is secured to the ceiling in a conventional manner.

Hangers 219 are used to attach respective pendants 402 from the first power bar 302A. Another hanger 220 is used to support a cluster of pendants 410.

The modular lighting system 10B includes second power bar 304A that is supported at one end by a hanger 222 that extends near the distal end of the first power bar 302A. The hanger 222 provides power to the second power bar 304A. A third power bar 306A is supported from the ceiling by ceiling hangers 216 (only one ceiling hanger is shown in FIG. 2 for clarity). The third power bar 306A supports the other end of the second power bar 304A and provides the second power bar 304A with power flowing through a hanger 224 to a plurality of pendants 412. Each of the power bars 302A, 304A, 306A can be used to hang pendants of various sizes and shapes and arranged in different configurations as desired.

Figure 3A:
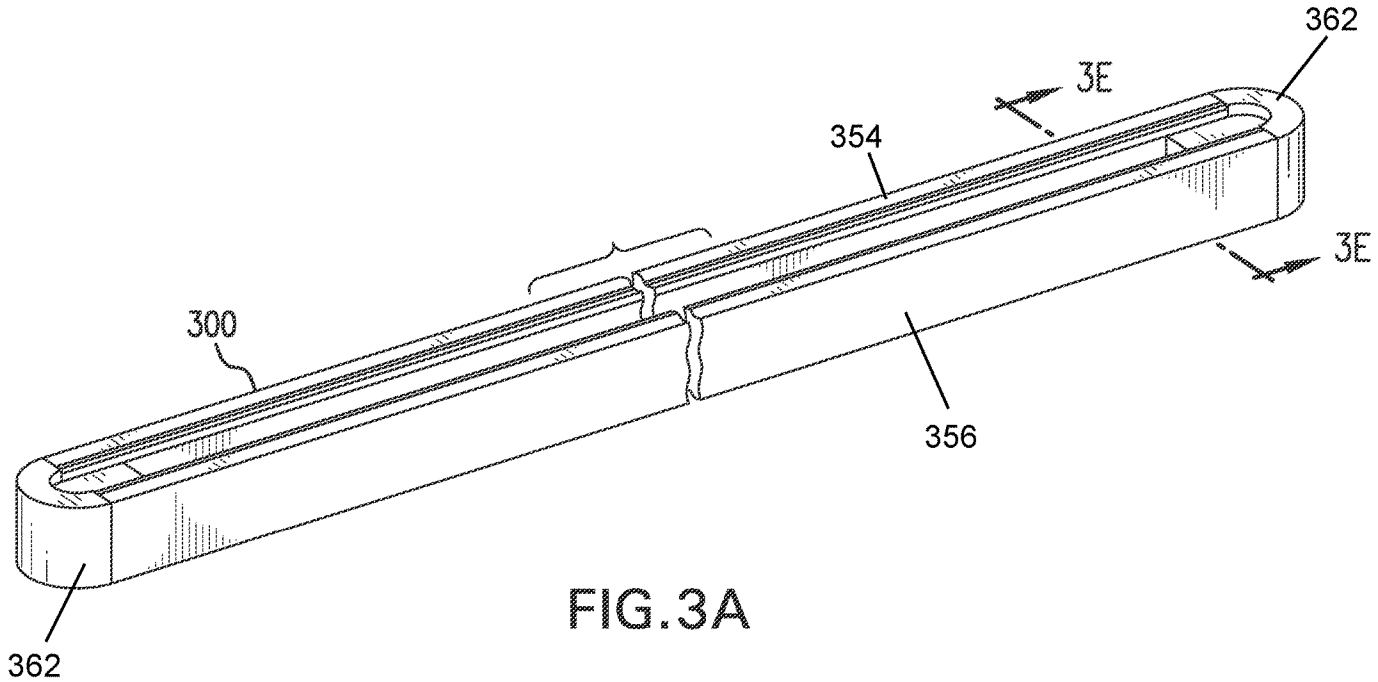
FIGS. 3A-3K are various views showing features of a power bar used in the modular lighting system of FIG. 1 or FIG. 2.
Figure 3B:
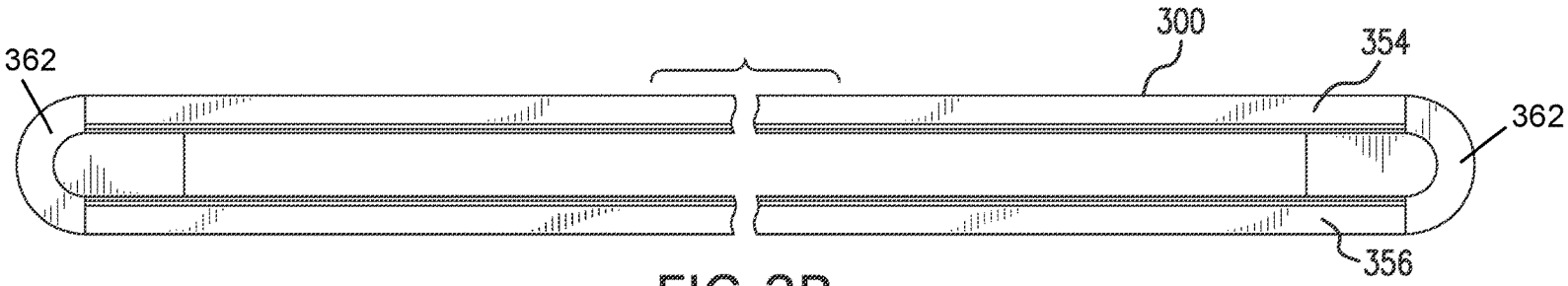
Figure 3C:
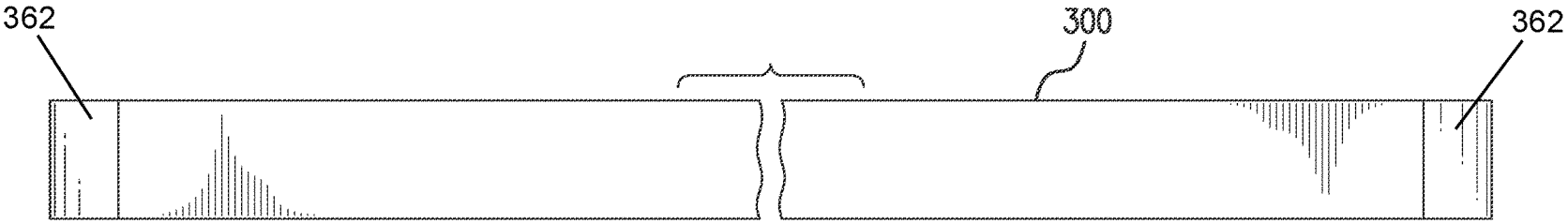
Figure 3E:
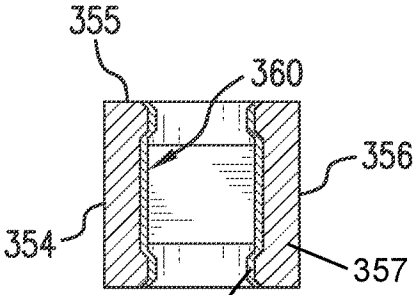
Figure 3D:
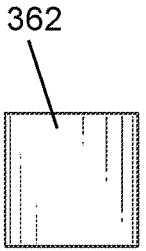
Figure 3F:
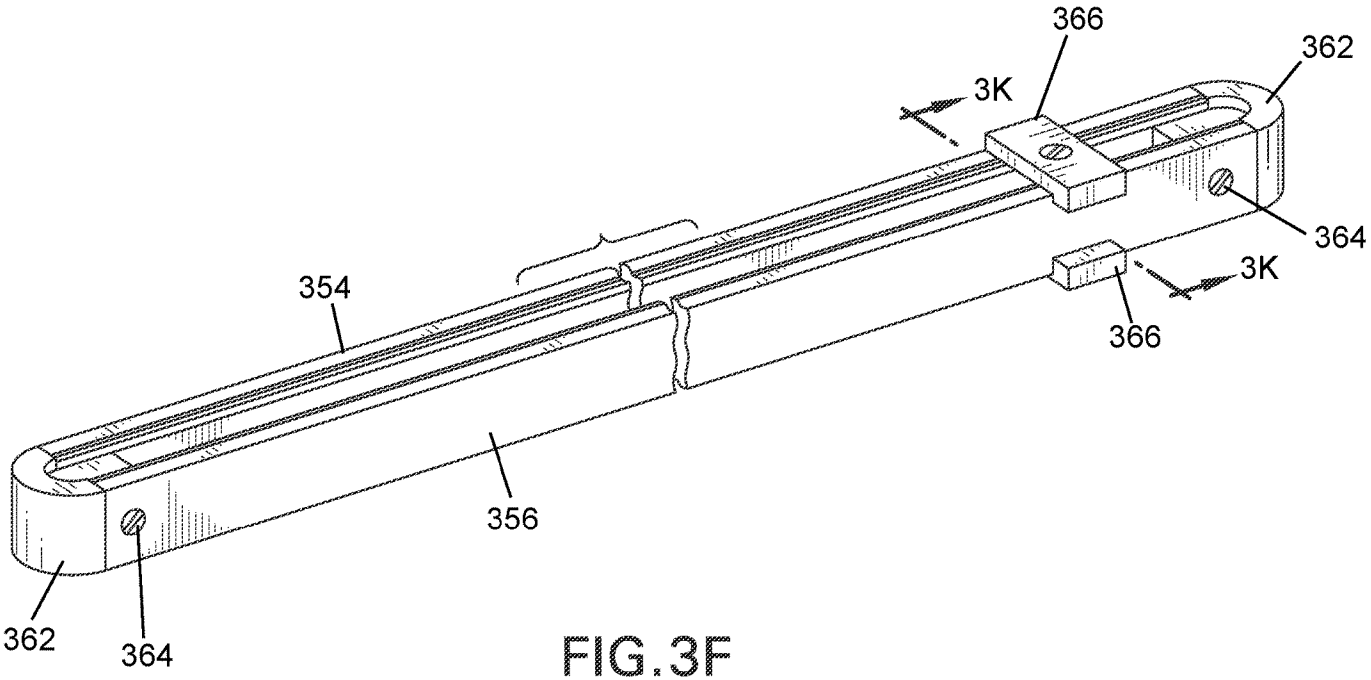
Figure 3G:
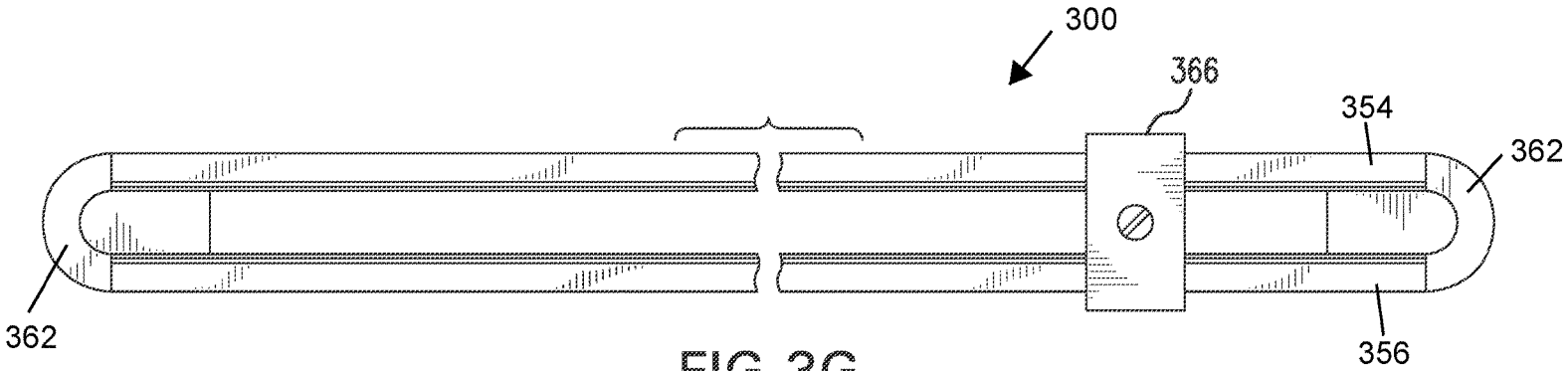

FIGS. 3A-3K show details of embodiments of a power bar 300. Unless otherwise noted, all of the power bars discussed previously and subsequently have the same configuration. The power bar 300 is merely a representative power bar of the power bars described herein. In FIGS. 3A-3K, the power bar 300 is shown as being straight. However, the power bar 300 can be circular (see FIGS. 5A-6C), ellipsoid or another geometric shape. The power bar 300 includes two identical longitudinal segments, or rail, 354, 356 that include inner surfaces that face each other. A cross-sectional view of the power bar 300 is shown in FIG. 3E. Each rail 354, 356 includes a C-shaped main body 355, 357, respectively, made of a non-conductive material, such as a plastic material that is light weight, but strong so that it can support various pendants, other power bars, etc. and channels 360 that are made of a light weight conductive material such as aluminum and are fixed to or are embedded into the inside surface of each rail 354, 356. Preferably, each rail 354, 356, includes a rectangular channel. The rails 354, 356 are joined together at each end by an end connector 362. The connectors 362 are attached to the rails 354, 356 by conventional means, such as screws 364, an adhesive or other means.

Figure 3H:
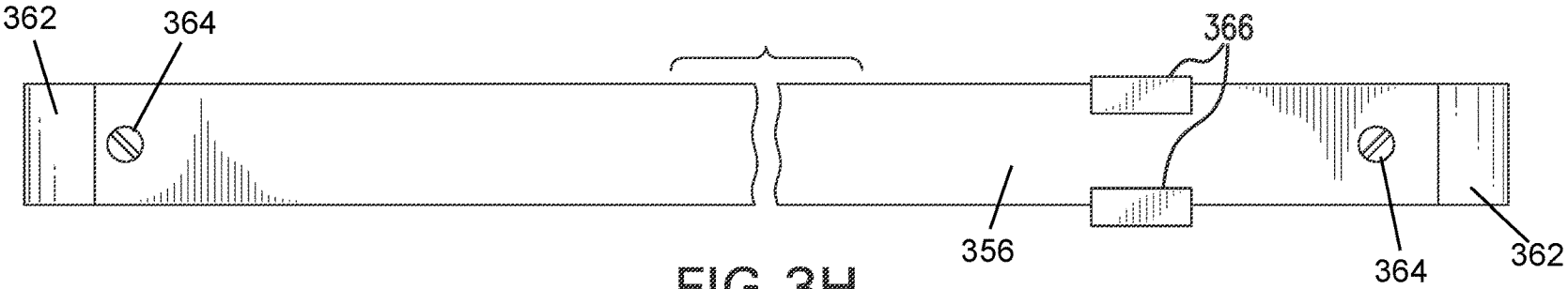
Figure 3K:
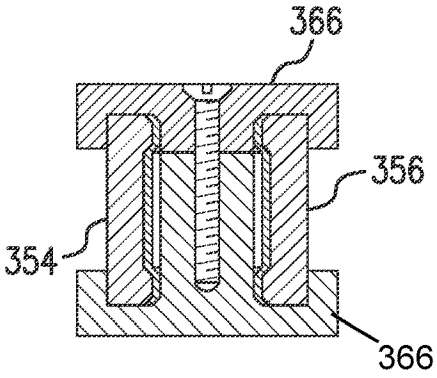
Figure 3J:
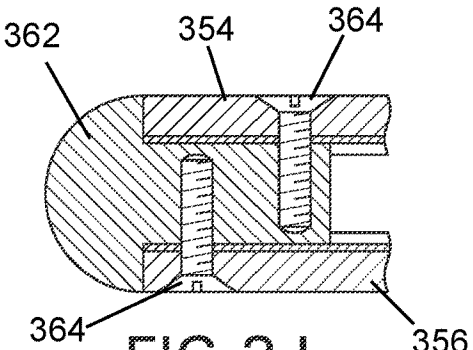
Figure 3I:
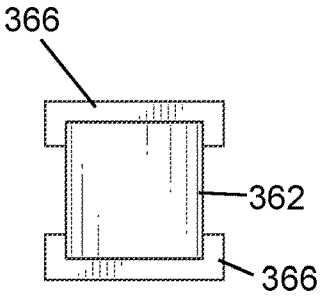

Preferably, the rails 354, 356 each have inner surfaces that are spaced at a nominal distance throughout the length of the power bar 300. The power bar 300 is made in standard lengths ranging from 12 to 48 inches. As shown in FIGS. 3H and 3K, for very long power bars, for example power bars exceeding twenty-four inches, a spacer 366 is placed between the rails 354, 356. The spacer 366 may be held in place by screws or other means.

FIGS. 4A-4G show details of a parallel bar hanger 206 from FIG. 1. The hanger 206 extends over the first power bar 302 and is used to support the second power bar 304 by extending under the second power bar 304. The hanger 206 includes two vertical segments 230A, 230B. Both the top and the bottom ends of the segments 230A, 230B are imbedded in identical W-shaped bases 232, which are shown in more detail in FIGS. 4B-4G.

The base 232 forms two channels 234, 236 with a wall 232C separating the two channels 234, 236. Two metallic springs or clips 240, 242 extend outwardly from the base 232 into the channels 234, 236, respectively. One of the clips 240 is electrically attached to one of the segments 230A within the base 232, and the other clip 242 is connected to the other of the segments 230B. Preferably, the base 232 is made of a non-conductive material and is overmolded to cover portions of the clips 240, 242 and the segments 230A, 230B. In one embodiment, both of the bases 232 between which the segments 230A, 230B extend, have a single, unitary structure. In another embodiment, at least one of the bases 232 is made of two sections 232A, 232B that snap together to form forming an interference fit therebetween.

Figure 4A:
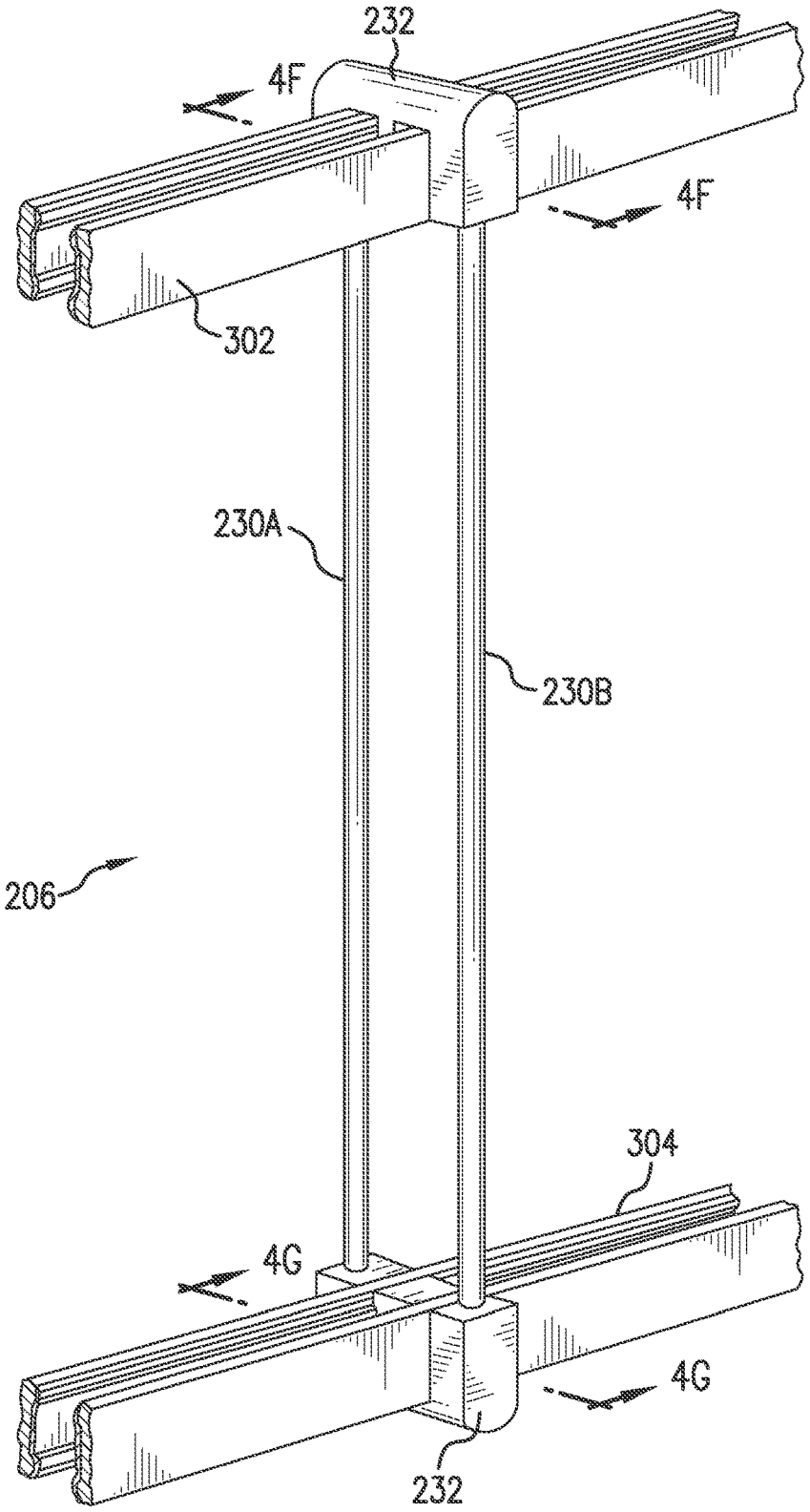
FIGS. 4A-4J are various views showing features of hangers used in the modular lighting system of FIG. 1 or FIG. 2.
Figure 4C:
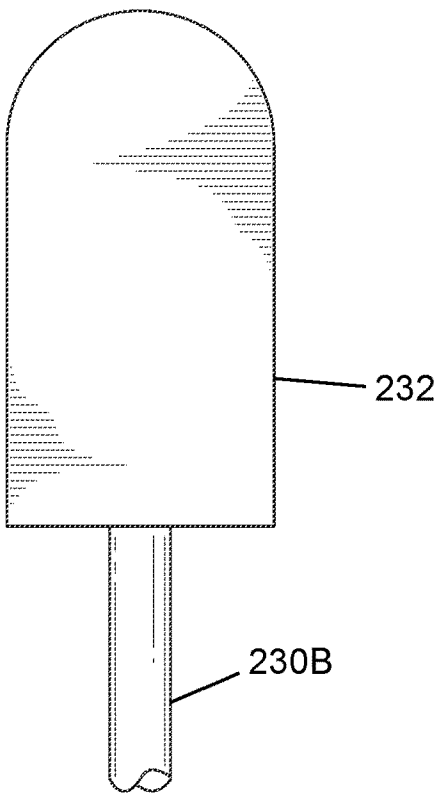
Figure 4B:
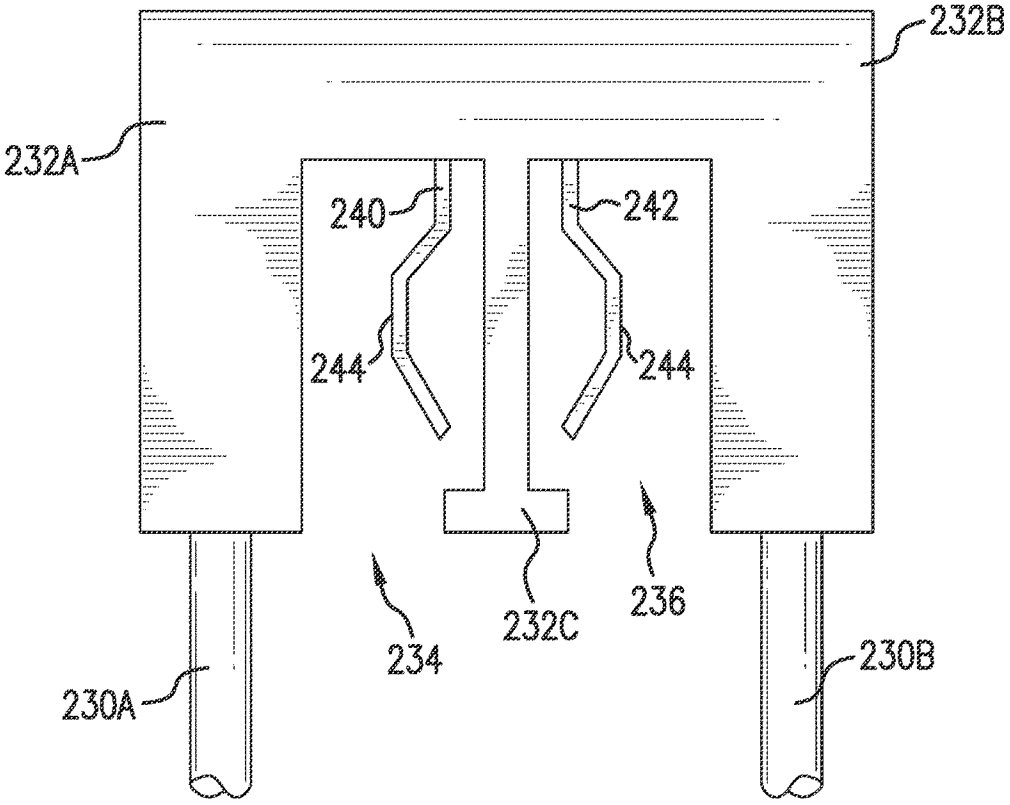
Figure 4D:
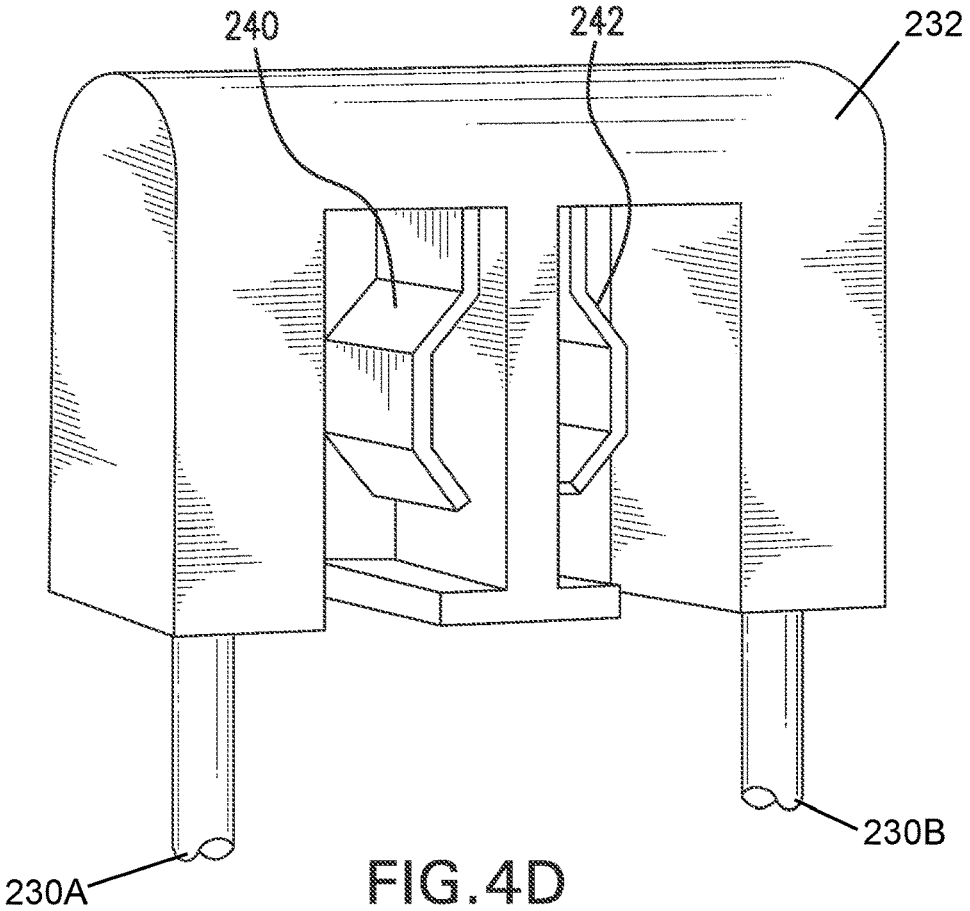
Figure 4E:
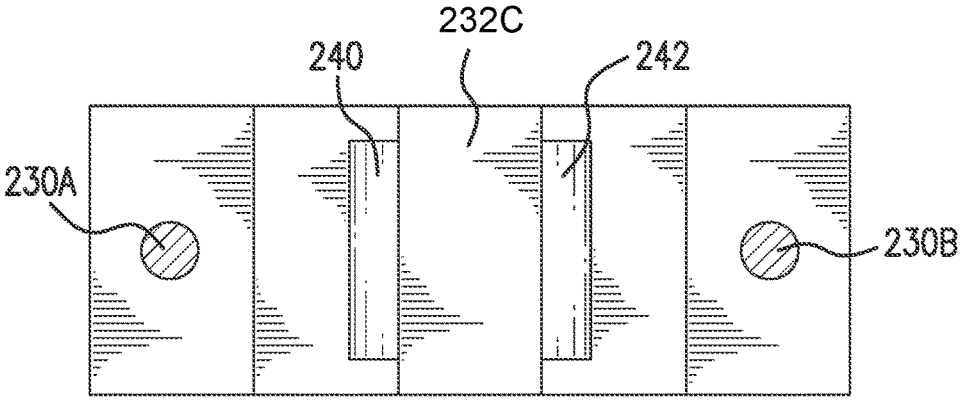
Figure 4F:
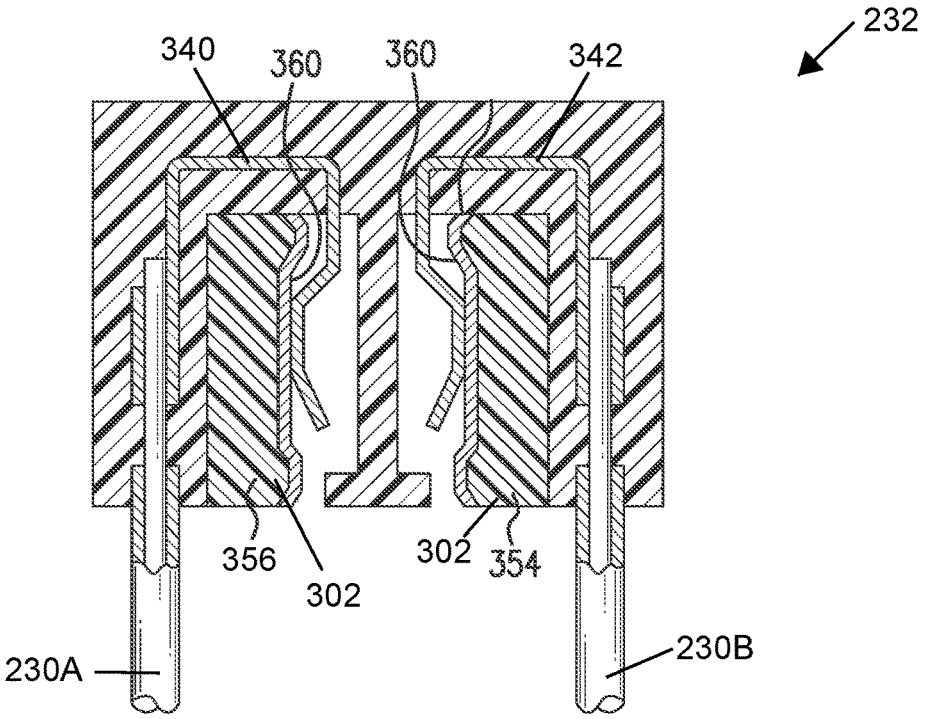
Figure 4G:
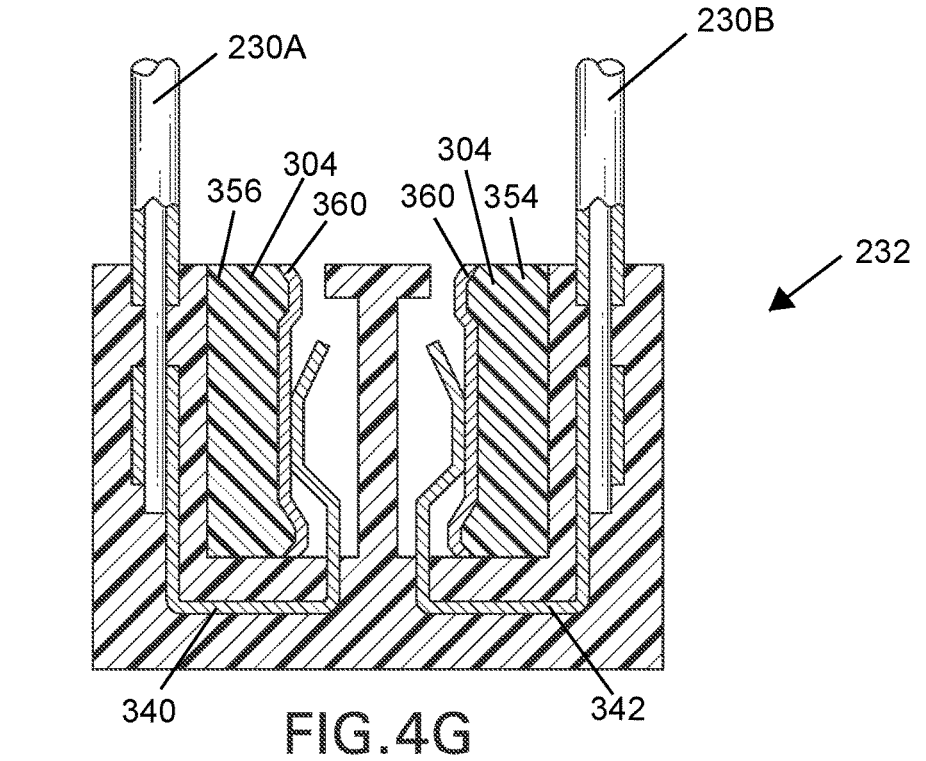
Figure 4H:
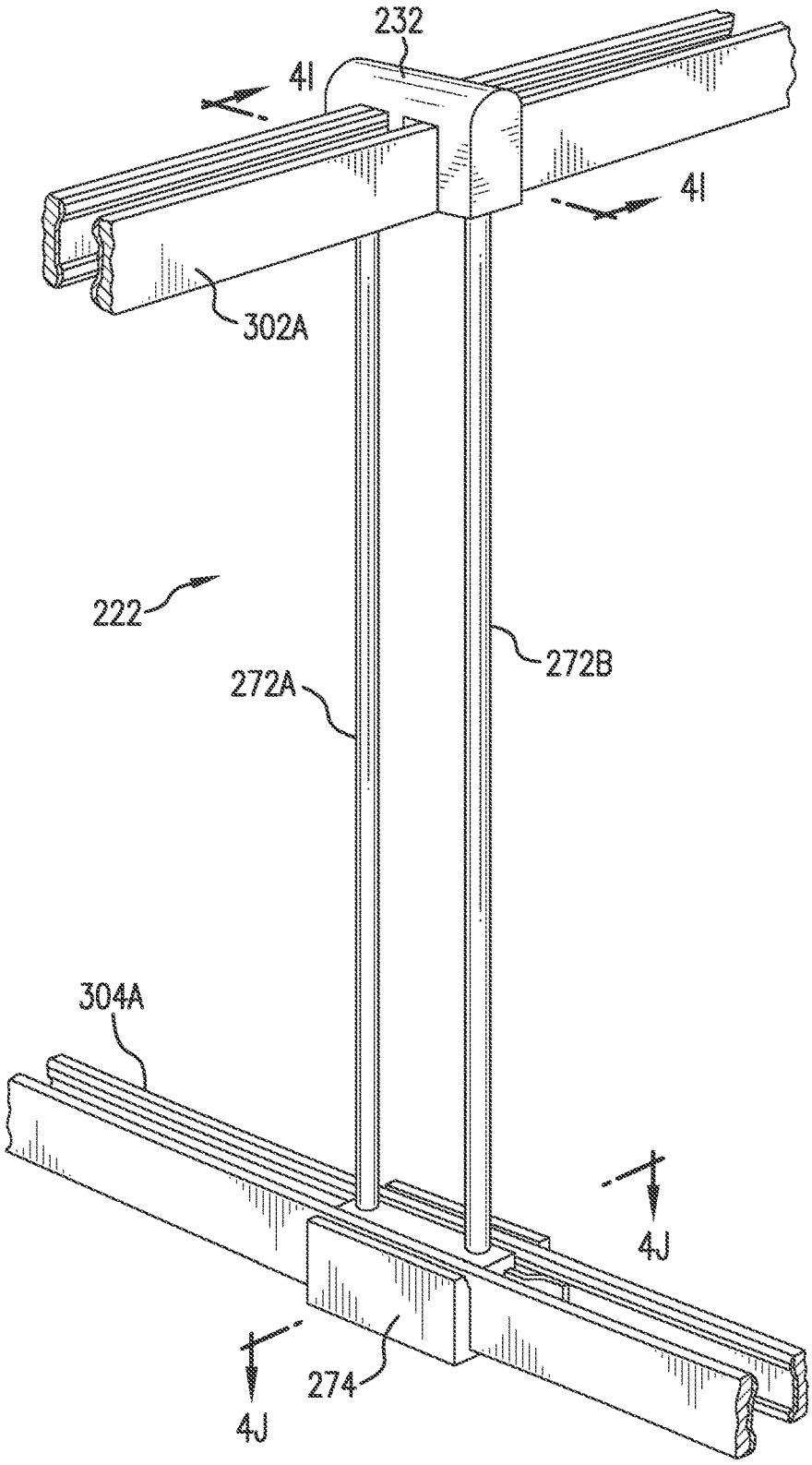
Figure 4I:
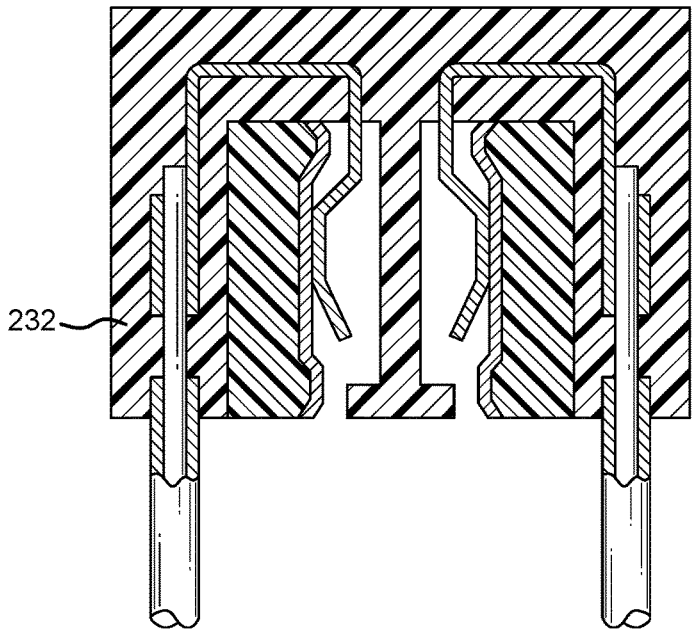

As can be seen in FIGS. 4F and 4G, the bases 232 are sized and shaped so that they fit over and engage the first power bar 302 and the second power bar 304. Importantly, the clips 240, 242 are sized and shaped so that they engage the rails 354, 356. The clips 240, 242 have flat sections 244 (see FIG. 4B) that are sized and shaped to snap into the rails 354, 356 of the first power bar 302 and the second power bar 304. In this manner, not only do the clips 240, 242 provide a solid electrical contact between flat sections 244 and the rails 354, 356, but they also stabilize the hangers on the bars and ensure that the lower bar 304 remains stiff and does move around in use. The clips 240, 242 may be made from beryllium copper.

The hanger 208 has a similar configuration, however, the clips 240, 242 need not be connected electrically to the hanger segments. For example, in the configuration shown in FIG. 2, hangers 222 do provide electrical connection to bars 304A and 306.

The hanger segments 230A, 230B are provided in various lengths as required to obtain the various systems described above, and they are preferably in the shape of rods made of a stiff, but somewhat springy material having shape memory alloys such as a phosphor/bronze. Preferably, except where an electrical contact is required, the rods are covered or painted with a thin electrically insulating material.

The hangers can be installed by separating the two segments 230A, 230B, passing the ends of the first power bar 302 and the second power bar 304 between the segments 230A, 230B, then lowering or raising the power bars 302, 304 toward the respective bases 232 and then snapping the bases 232 onto the power bars 302, 304 into the configurations shown in FIGS. 4F and 4G.

Figure 4J:
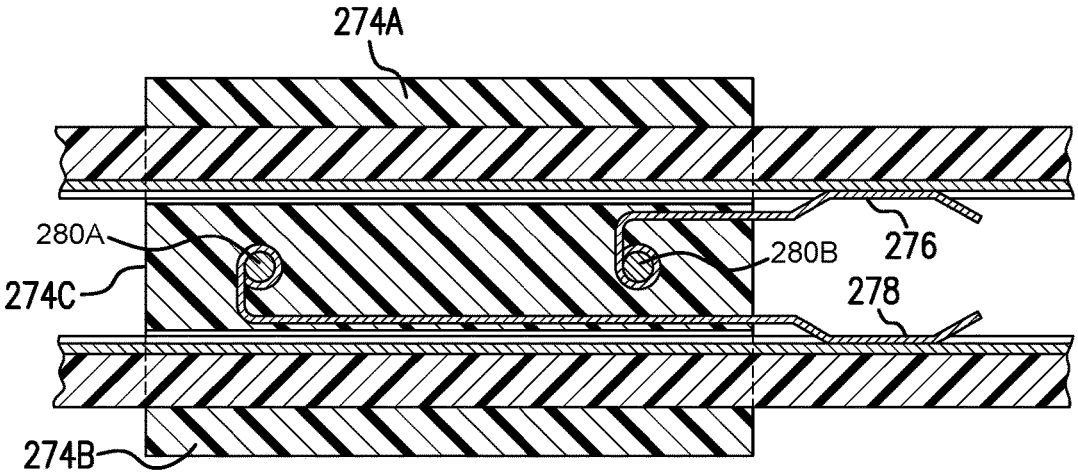

As discussed above, and illustrated in more detail below, in some instances, the power bars extend perpendicularly to each other. For example, in FIG. 2, the first power bar 302A and the second power bar 304 are perpendicular to each other. These bars are interconnected using a hanger 222 shown in FIG. 4H. The hanger 222 has two hanger segments 272A, 272B and a base 232 at the top similar to the base 232 in FIGS. 4A-4I. However, at the bottom, the hanger 222 has a different base 274 as shown in FIG. 4J. The base 274 is formed with two side wings 274A, 274B and a center wall 274C as shown in FIG. 4J. Clips 276, 278 are provided on the center wall 274C and are connected electrically with segments 272A, 272B, respectively as shown in FIG. 4J. The center wall 274C is made with two holes 280A, 280B with the lower ends of the hanger segments 272A, 272B extending into the holes and being secured to the base 204. The base 274 is sized and shaped to engage and support the power bar 304A with the hanger segments 272A, 272B providing power to the power bar 304A. The base 232 supports the first power bar 302 and provides the similar structure as discussed above and shown in FIGS. 4B-4G.

In FIGS. 1 and 2, the power bars 302, 302A, 304, 304A, 306A are linear. However, as noted above, the power bars 302, 302A, 304, 304A, 306A can have non-linear shapes as well, such as circular, oval, ellipsoid, etc. Non-linear power bar are shown in an embodiment in FIG. 5A. Here, a modular lighting system 500 is shown that includes two circular power bars 502A, 502B. Pendants, such as those similar to the pendants 402, 410, 412 of the embodiment of FIG. 2 may be hung from the circular power bars 502A, 502B, but have been omitted for simplicity. The two power bars 502A, 502B are disposed at separate heights in an overlapping relationship and they have the same structure as the linearly extending power bars (e.g., power bars 302) discussed above.

Power bars 502A, 502B are supported by ring power feed hangers 1204A, 1204B, one or more ceiling hangers 1206, one or more live hanger 1208 and a dead hanger 1210. The terms "live" and "dead" are used to indicate whether the respective hanger conducts electricity or is merely used as a mechanical support. In other words, the rods 1232A, 1232B (see e.g., FIGS. 5B-5D) (discussed in more detail below) of the live hangers 1208 are electrically connected to the rails within each of the respective power bars 502A, 502B. The rods 1210C (see FIG. 5E) of the dead hangers 1210 and the ceiling hangers 1206 are electrically isolated (or grounded).

Figure 5A:
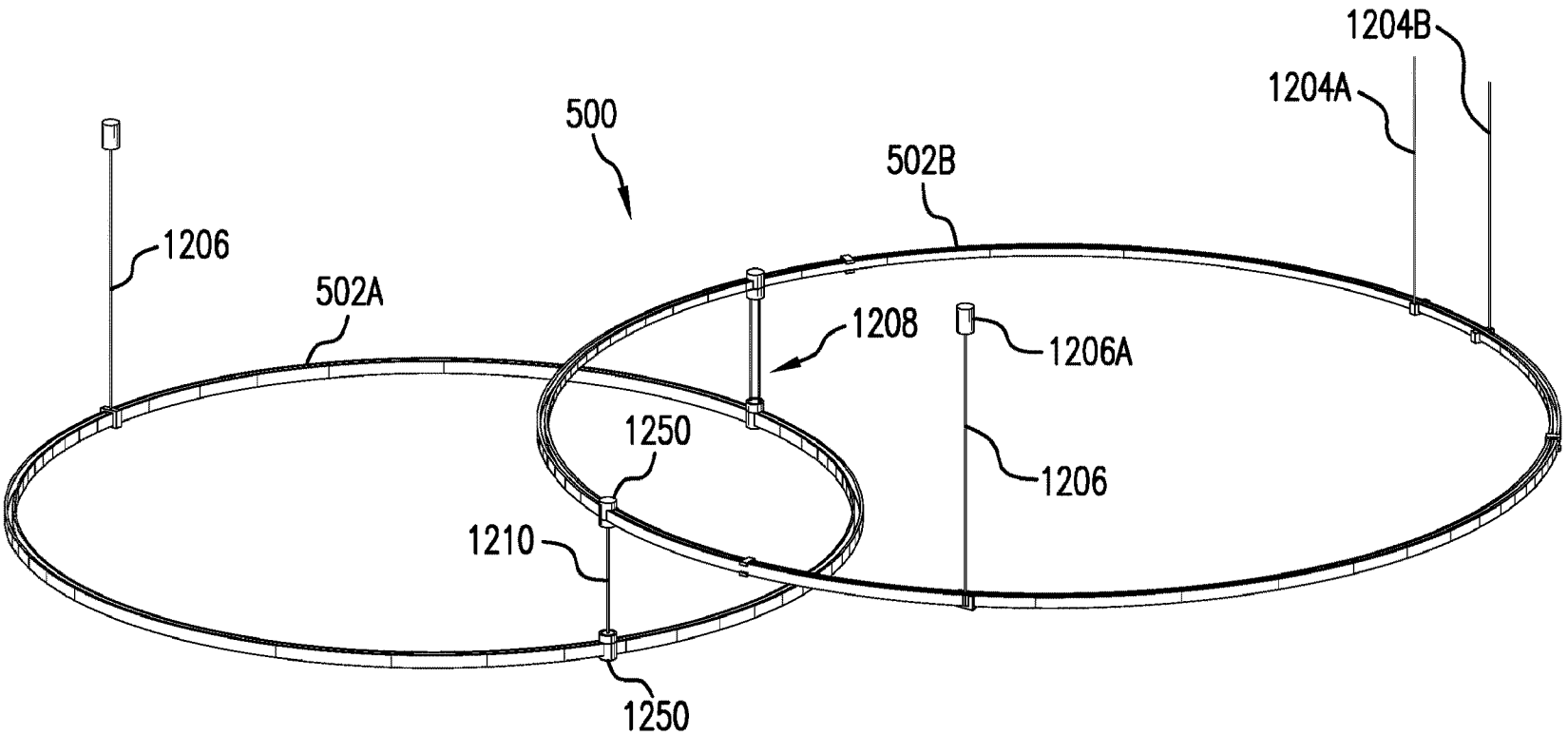
FIGS. 5A-5E are various views showing features an embodiment of a modular lighting system and hangers and power bars that are part of said system.
Figure 5C:
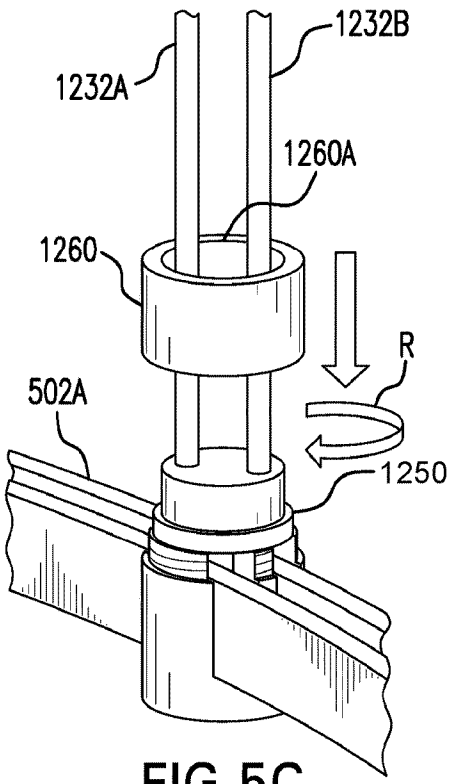
Figure 5B:
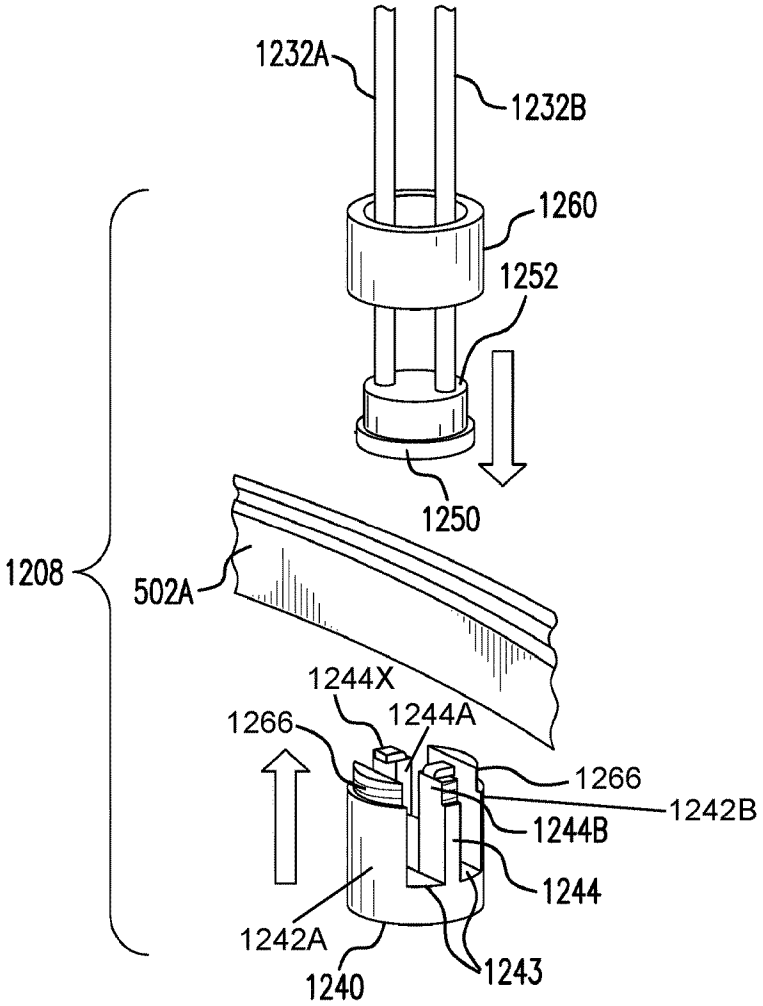
Figure 5E:
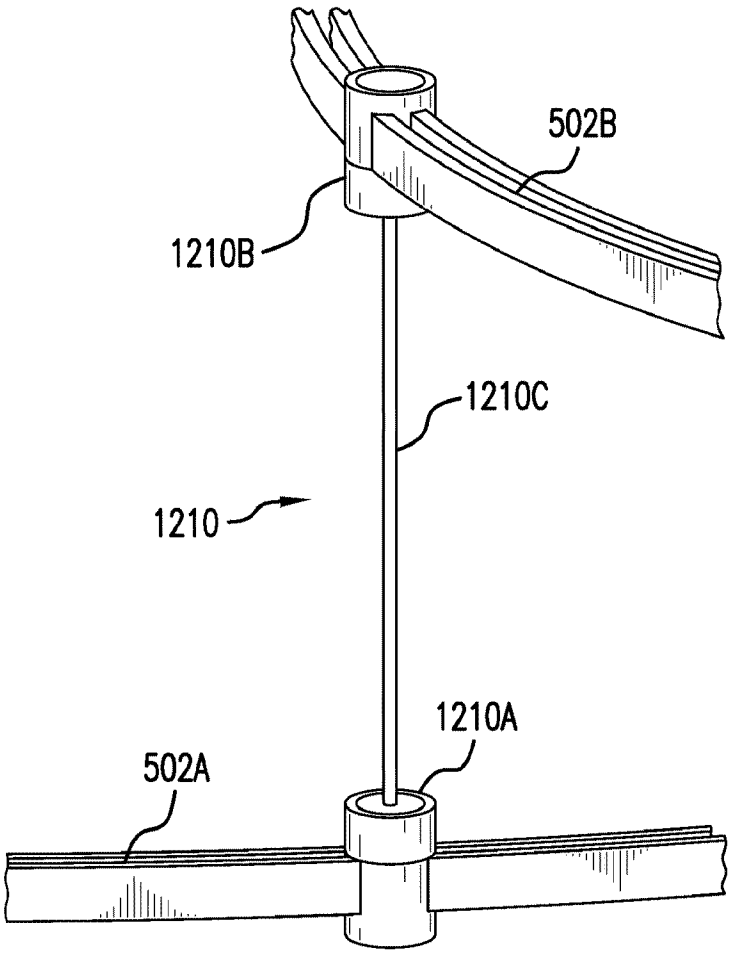
Figure 5D:
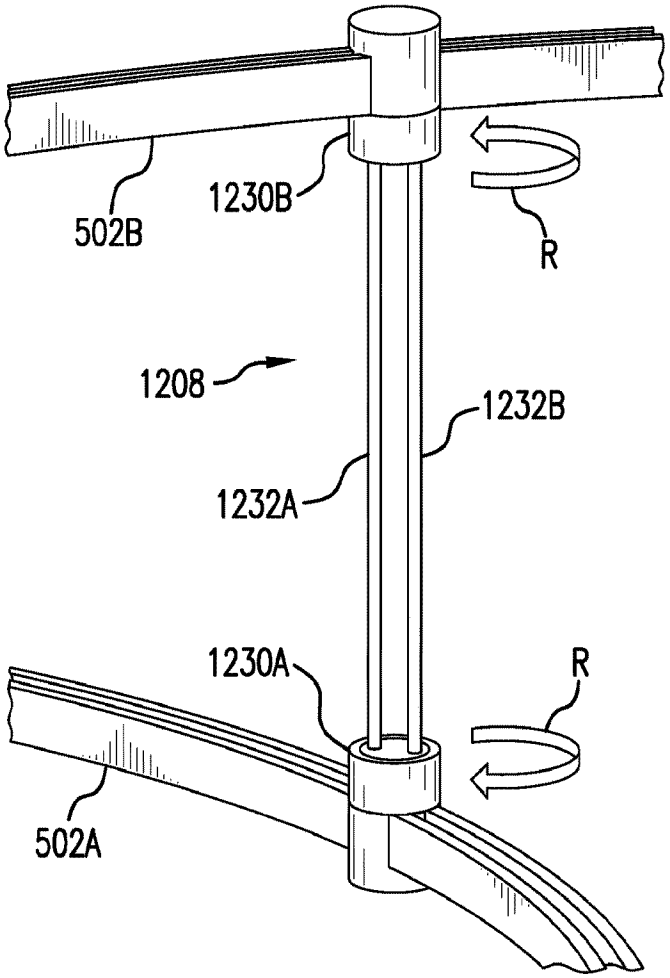

As shown in FIGS. 5B-5D, the live hanger 1208 includes two cylindrical members 1230A, 1230B and two rods 1232A, 1232B that extend between the cylindrical members 1230A, 1230B. Each cylindrical member 1230A, 1230B includes a base 1240, two arms 1242A, 1242B that extend upwardly from the base 1240 and a center piece 1244 that extends upwardly from the base 1240, between the arms 1242A, 1242B and that has two vertical extensions 1244A, 1244B. Two cavities or slots 1243 are formed between the arms 1242A, 1242B, and the center piece 1244. The slots 1243 are configured to receive the two segments of bar 502A as shown, for example, in FIG. 5C. The extensions 1244A, 1244B have metallic tips 1244X electrically connectable to clips disposed in the cavities 1243 (not shown) similar to the clips 240, 242 in FIG. 4B.

The base 1240 engages the respective bar 502A, 502B so that the clips snap between the bar segments and engage the rail disposed between these bar segments as discussed above in relation to the structure and operation of hangers 206 in FIG. 4A. The elements of base 1240 are arranged so that when the base 1240 engages the bar 302A, 502B, the extensions 1244A, 1244B are electrically connected to the conductive rails thereof.

Each member 1230A, 1230B further includes a top portion 1250 that has a top surface 1252, which receives the ends of the rods 1232A, 1232B. Each top portion 1250 is configured to be placed over the respective base 1240 so that the tips of the bars 1232A, 1232B are in contact with and electrically connected to the tips 1244X of the extensions 1244A, 1244B, respectively. As shown in FIG. 5C, during assembly of the top portion 1250 with the base 1240, a sleeve 1260 is lowered over the top portion 1250 and twisted by 120 degrees as shown by arrow R to engage the base 1240. An interior surface 1260A of the sleeve 1260 is threaded and arranged to engage threads on a portion 1266 of the cylindrical members 1230A, 1230B and interlock the base 1240 to the top portion 1250 as shown in FIGS. 5B-5D to ensure electrical contact is established between bars 502A, 502B. Of course other interlocking means may be used as well.

As shown in FIG. 5E, the hanger 1210, which is used to support power bar 502A from power bar 502B, includes two cylindrical members 1210A, 1210B that each have a similar structure to the members 1230A, 1230B, but with only a single rod (or a cord) 1210C that is not connected electrically to any of the conductive members of the bars extending between the members 1210A, 1210B.

Figure 6A:
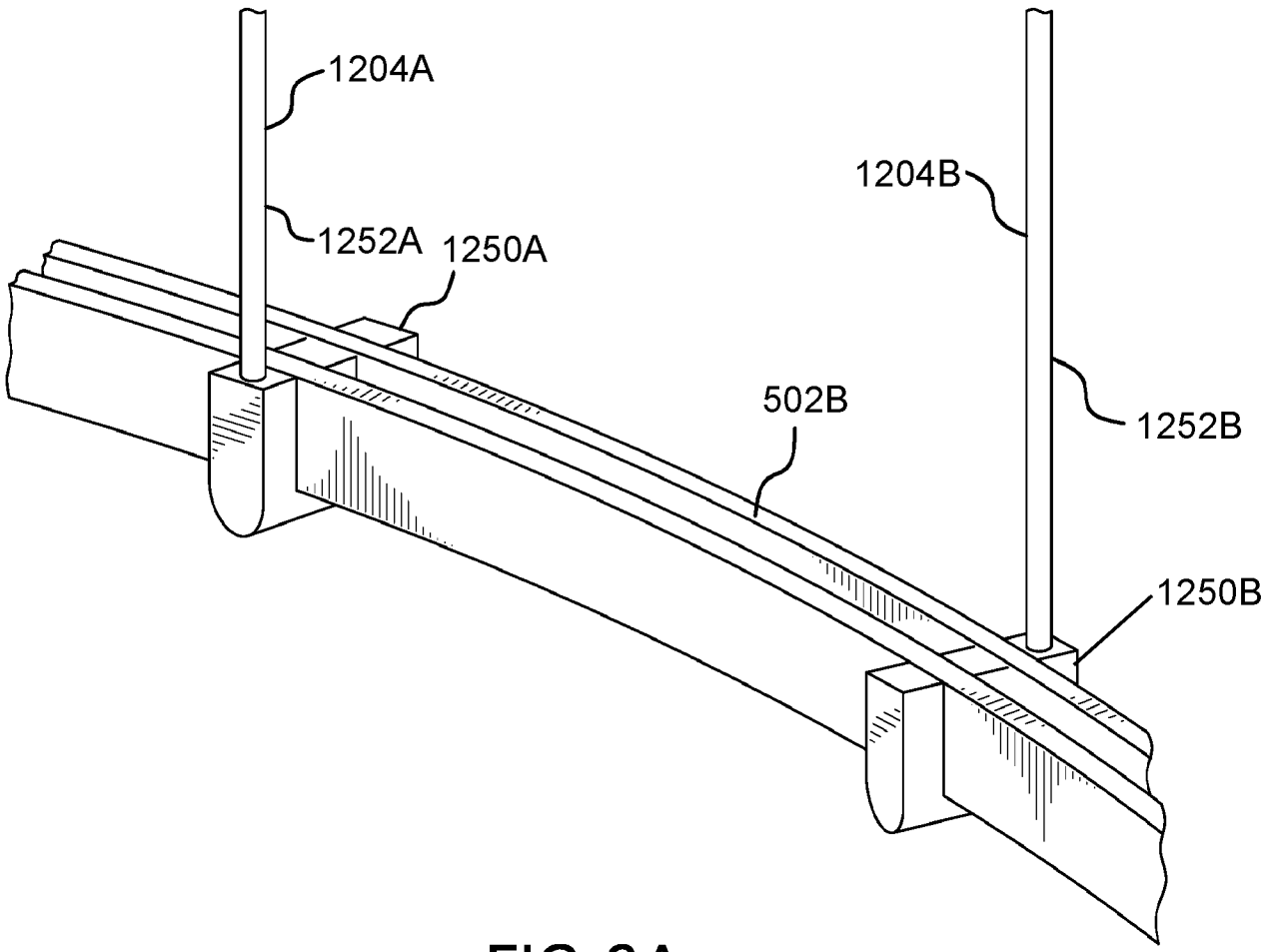
FIGS. 6A-6C are various views showing embodiments of other hangers that can be included as part of the modular lighting system depicted in FIGS. 5A-5E.

FIG. 6A shows an enlarged orthogonal view of hangers 1204A, 1204B. Each hanger 1204A, 1204B includes a body 1250A, 1250B that may be W-shaped and is attached to the lower end of a rod 1252A, 1252B. More particularly, the rod 1252A, 1252B is disposed on one side of the body 1250A, 1250B. The body 1250A, 1250B is snapped on bar 502B. The upper end of each rod 1252A, 1252B can be attached to a mounting structure or, in an embodiment (not shown), attached to another body identical to body 1250A, 1250B, but snapped on bar 502B. Each of the hangers 1204A, 1204B can engage one of the electric strips of the bar 304 and through which power is provided from a respective canopy (not shown). Importantly the hangers 1204A, 1204B are almost the same structure as hangers 206 shown in FIG. 4A, the only difference being that hangers 1204A, 1204B have only one rod 1252A, 1252B, respectively, and therefore two such hangers 1208 must be used to power the respective bars 502A, 502B. It should be noted that hangers 1204A, 1204B, 1206, 1208 and 1210 are all interchangeable and can be used to support and power bars whether the power bars are linear or have some other shapes.

Figure 6C:
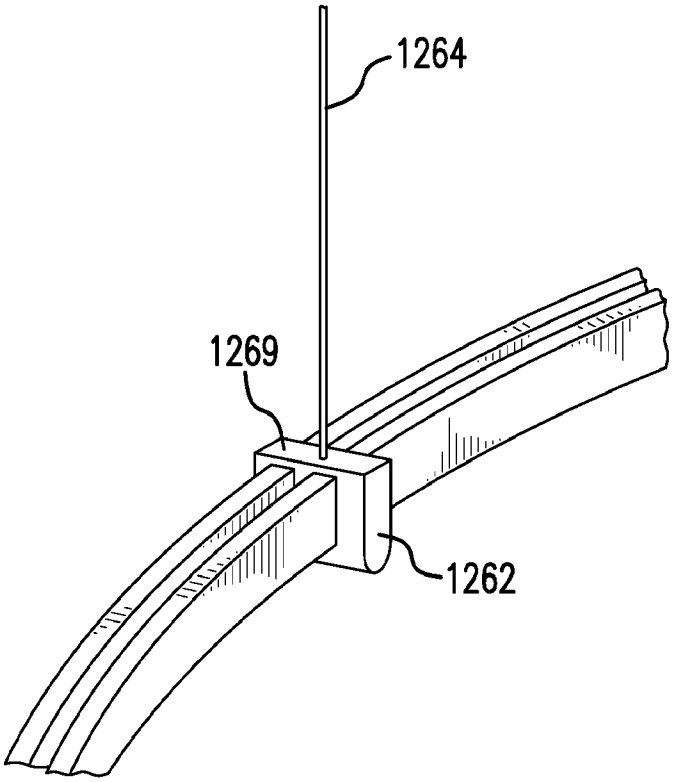
Figure 6B:
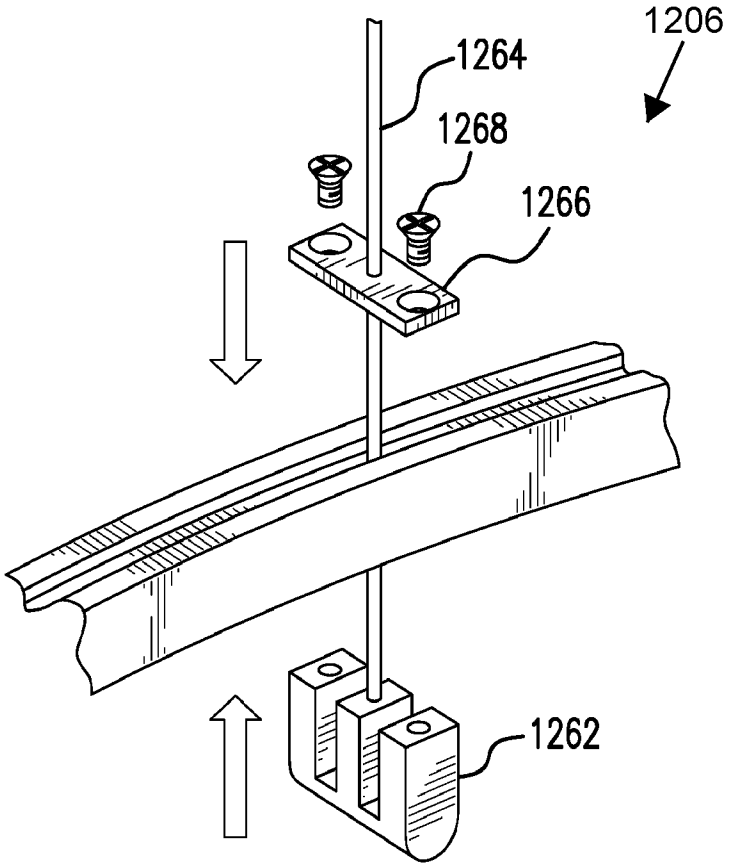

FIGS. 6B and 6C show an embodiment of another non-electric support 1206. It has a similar body 1262 to the bodies 1250A, 1250B, but without clips. The support 1206 further includes a rod 1264 attached to a center portion of the body 1262. A cover 1266 is attached to body 1262 by screws 1268 or other means to ensure that the bar 502B does not separate from the hanger 1206. The upper end of the rod 1262 is connected to a member 1206A suitable for attaching to the ceiling or any other structural member.

Numerous modifications may be made to this invention without departing from its scope as defined in the appended claims.

What is claimed is:

1. A hanger that is configured to support a power bar of a lighting system, the power bar including two segments with respective rails arranged and constructed to deliver power to pendants, said hanger comprising:

a one-piece cylindrical member having a base, a first arm extending in a first direction directly from the base, a second arm that is spaced from the first arm extending in the first direction directly from the base and a center piece extending directly from the base in the first direction between the first arm and the second arm forming two cavities, including a first cavity formed between the first arm and the center piece and a second cavity formed between the second arm and the center piece, each of the cavities being configured to receive one of the respective rails of the power bar;

a top, which is independent of the cylindrical member, arranged above said cylindrical member and covering said cavities of the cylindrical member; and at least one rod attached to and extending upwardly from said top.

2. The hanger of claim 1, further comprising clips disposed in said first cavity and said second cavity of said cylindrical member that are configured to form an interference fit with said respective rails of the power bar.

3. The hanger of claim 1, wherein the center piece includes a first extension and a second extension that, at least in part, are spaced from each other.

4. The hanger of claim 1, further comprising a coupling sleeve selectively coupling said top to said cylindrical member.

5. The hanger of claim 1, wherein the lighting system includes a second power bar, said rod includes a first end connected to said top and a second end and said hanger further comprises another cylindrical member to which the second end of the cylindrical member is attached that is configured to engage the second power bar.

6. A hanger configured to support a first power bar from a second power bar of a modular lighting system, the first power bar and the second power bar being vertically offset from each other, at least one of the first power bar and second power bar supporting and providing power to pendants of the modular lighting system, the hanger comprising:

a first cylindrical member and a second cylindrical member, each of the first cylindrical member and the second cylindrical member including a cylindrical base having a first cavity and a second cavity, each said first cavity and second cavity are configured to receive the first segment and the second segment of the first power bar and the second power bar, a central element disposed between said first cavity and said second cavity extending directly from said base and having a contact surface, a first connector and a second connector disposed on said contact surface, and a top, separate from and disposed above said first cavity and said second cavity and configured to entrap the first segment and said second segment of the first power bar and said second power bar within said first cavity and said second cavity, respectively, and a sleeve selectively coupling said top to said cylindrical base; and a first rod and a second rod disposed in parallel to each other, each of said first rod and said second rod having a first end attached to the top of said first cylindrical member and a second end attached to the top of said second cylindrical member.

7. The hanger of claim 6, further comprising clips disposed in said first cavity and said second cavity of said cylindrical member.

8. The hanger of claim 6, wherein said top has a circular shape with a diameter equal to a diameter of said circular base.

9. The hanger of claim 8, wherein said coupling member is cylindrical sleeve having an inner diameter configured to receive said top and said cylindrical base.

10. The hanger of claim 9, wherein said sleeve has an inner surface with threading and said cylindrical base has an outer surface selectively engaging said inner surface.

* * * * *